US009474335B2

(12) United States Patent
Heller

(10) Patent No.: US 9,474,335 B2
(45) Date of Patent: Oct. 25, 2016

(54) SECURITY KEY RING

(71) Applicant: Brian Heller, Edgewater, NJ (US)

(72) Inventor: Brian Heller, Edgewater, NJ (US)

( * ) Notice: Subject to any disclaimer, the term of this patent is extended or adjusted under 35 U.S.C. 154(b) by 177 days.

(21) Appl. No.: 14/305,346

(22) Filed: Jun. 16, 2014

(65) Prior Publication Data

US 2015/0359300 A1 Dec. 17, 2015

(51) Int. Cl.
*A44B 17/00* (2006.01)
*A44B 15/00* (2006.01)

(52) U.S. Cl.
CPC ..... *A44B 15/002* (2013.01); *Y10T 24/3487* (2015.01); *Y10T 24/3492* (2015.01); *Y10T 24/45251* (2015.01)

(58) Field of Classification Search
CPC ..... A44B 15/002; A44B 15/00; Y10T 24/45251; Y10T 70/8676; Y10T 70/8757
See application file for complete search history.

(56) References Cited

U.S. PATENT DOCUMENTS 1,349,468 A * 8/1920 Morrison ..... A45F 5/02 24/3.12
2,823,537 A * 2/1958 Segal ..... A44B 15/00 24/600.6
3,481,169 A * 12/1969 Rossi ..... A45C 11/32 70/408
4,133,195 A * 1/1979 McLaren ..... A47G 29/10 70/456 R
4,425,772 A * 1/1984 Brewer ..... A44B 15/00 70/456 R
5,457,976 A * 10/1995 Stillwagon ..... A44B 15/002 24/3.6
6,003,352 A * 12/1999 Yu ..... A44B 15/00 24/599.8
7,021,852 B1 * 4/2006 Turner, III ..... B42F 13/16 24/3.6
8,782,868 B2 * 7/2014 White ..... A44B 15/002 24/3.6
2010/0122709 A1 * 5/2010 Janatpour ..... A45F 5/00 132/286
2010/0307209 A1 * 12/2010 Brown ..... A44B 15/00 70/456 R

* cited by examiner

*Primary Examiner* — Robert J Sandy
*Assistant Examiner* — Matthew Sullivan
(74) *Attorney, Agent, or Firm* — Welsh Flaxman & Gitler LLC

(57) ABSTRACT

A key ring including a continuous loop of material including a first section extending for the majority of the circumference of the continuous loop of material having a thickness of D1, and a indented second section extending for the remainder of the circumference of the continuous loop having a thickness D2 less than D1. The key ring also includes a securing device slidable about the continuous loop to cover and uncover the indented second section. One or more spring clips including a moveable arm having a tip end and a fixed member to which the movable arm is attached, the moveable arm moving between an opened position and a closed position, wherein a distance D3 is provided between the tip end of the moveable arm and a hook end of the fixed member when the moveable arm is in the opened position abutting the fixed member. The distance D3 is greater than D2, and less than D1 thus only allowing the spring clip to be attached and removed from the key ring at the indented second section of the continuous loop of material. The spring clip includes a split key ring.

12 Claims, 3 Drawing Sheets

SECURITY KEY RING

BACKGROUND OF THE INVENTION

1. Field of the Invention

The present application is directed to a key ring for the secure retention and easy removal of a plurality of spring clips with split rings to which keys can be attached.

2. Description of the Related Art

Prior art key rings take many forms. The majority of key rings are fabricated as split key rings by winding a metal bar, having a relatively small first diameter, in an overlapping configuration to produce a coil. Since the coil is produced by the metal bar overlapping itself, the coil has an effective diameter of twice that of the first diameter for the majority of the circumference of the key ring. The metal bar used in the construction of such coils includes a first end and a second end. When the metal bar is wound in its overlapping configuration, the first and second ends terminate a small distance from one another, thereby creating a scalloped portion having the first diameter.

In practice, when a key is to be securely placed on the split key ring, the user must separate one of the ends from the coil, generally employing one of the user's fingernails, to create enough separation between the end and the remainder of the coil to permit placement of the key onto the key ring. Similarly, if the user wishes to remove a key from the split key ring, the user must again use one of his/her fingernails to provide the appropriate separation between one of the ends and the coil to permit withdrawal of the key from the split key ring.

As can be appreciated, employing a fingernail of the user to cause separation of one of the ends from a relatively rigid coil often results in damage to the user's fingernail. Alternatively, the use may employ a tool, such as a knife, screwdriver or other implement to create the aforementioned separation. However, the use of an additional implement to produce the separation complicates the process of placing or removing a key from the split key ring.

SUMMARY OF THE INVENTION

It is, therefore, an object of the present invention to provide a key ring provided with a structure allowing spring clips with split key rings to be easily placed or removed from the key ring.

Another object of the present invention is to provide a key ring with a securing device to secure one or more spring clips with split key rings on the key ring.

Yet another object of the present invention is to provide a key ring in which the securing device to secure the spring clips with split key rings on the key ring is moveable along the circumference of the key ring.

The objects of the present invention are accomplished by providing a key ring constructed from a rigid material in the form of a continuous loop, such as a circle or other geometric figure, having a first thickness for the majority of the circumference of the continuous loop (designated as a first section). The remainder of the circumference of the continuous loop encompasses a second indented section having a second thickness less than the first thickness. The key ring includes a securing device to secure the spring clips with split key rings on the key ring, and is designed to move over the continuous loop of material. When the securing device is in a first position on the continuous loop, the securing device completely covers the second indented section of the circumference.

Each spring clip includes a moveable arm and a fixed member. The moveable arm pivots to move between a first closed position to a second opened position. When the moveable arm is in the second opened position, the top of the moveable arm abuts a portion of the fixed member. The distance between the top of the moveable arm and a hook provided on the end of the fixed member is less than the first thickness, but greater than the second thickness of the continuous loop of the key ring. Therefore, the spring clip can only be placed on, or removed from the key ring when the spring clip is in proximity to the second indented section of the continuous loop having the second, smaller thickness. Since the thickness of the majority of the circumference of the continuous loop of the key ring is of the first, greater thickness, the spring clip can only be attached at the second indented section. This is because the spring clip, when fully opened and in the opened position, does not fit over the thickness of the first section. Consequently, when the securing device is in the position completely covering the smaller thickness second portion of the continuous loop of the key ring, any accidental movement of the moveable arm of the spring clip to the opened position will not result in the removal of the spring clip and the split key ring attached thereto from the key ring. Once again that is because the distance between the hook of the fixed member of the spring clip and the movable arm when fully opened is less than the first diameter or thickness of the continuous loop of the key ring. It is only when the securing device to secure the keys is moved away from the second indented section to the first section that the spring clip is capable of accessing the reduced thickness second portion of the continuous loop of the key ring. In this way, the spring clip with split key ring is permitted to be placed on or removed from the continuous loop of the key ring.

Other objects and advantages of the present invention will become apparent from the following detailed description when viewed in conjunction with the accompanying drawings, which set forth certain embodiments of the invention.

DESCRIPTION OF THE PREFERRED EMBODIMENTS

Figure 1:
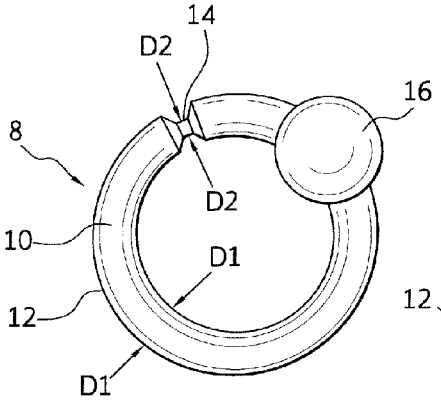
FIG. 1 is a view of the key ring showing a first securing device to secure the spring clips with split key rings in a first position uncovering the second indented section.

The detailed embodiments of the present invention are disclosed herein. It should be understood, however, that the disclosed embodiments are merely exemplary of the invention, which may be embodied in various forms. Therefore, the details disclosed herein are not to be interpreted as limiting, but merely as a basis for teaching one skilled in the art how to make and/or use the invention.

FIGS. 1-5 illustrate the teachings of the present invention in which a key ring 8 is formed of a continuous loop 10 including a first section 12 having a thickness or diameter D1 extending for the majority of the circumference of the continuous circular loop 10. The remainder of the circumference of the continuous circular loop 10 includes an indented second section 14 having a thickness or diameter D2 less than the thickness or diameter D1 of the first section 12.

The key ring 8 is constructed from a sturdy metallic or hard plastic material. Additionally, it is appreciated the key ring 8 can take many shapes, as long as the key ring 8 includes a continuous loop of material including an indented section with a thickness or diameter D2 less than the thickness or diameter D1 of the remainder of the continuous loop.

A spherically shaped securing device 16 is mounted upon the continuous loop 10. In accordance with a disclosed embodiment the securing device 16 is a ball constructed from a semi-hard material. The securing device 16 can be rubber, silicone, plastic or other materials which provide for frictional sliding of the securing device 16 on the continuous circular loop 10. The securing device 16 is designed to move along the surface of the continuous loop 10 between the position shown in FIG. 2 uncovering the indented second section 14 and the position shown in FIG. 3 in which the indented second section 14 is covered. Frictional interaction between the securing device 16 and the continuous loop 10 is used to generally maintain the securing device 16 in the position shown in FIG. 3 covering the indented second section 14. The user of the key ring 8 can, by pushing or pulling the securing device 16, exert sufficient force to overcome the frictional attachment and move the securing device 16 between the positions shown in FIGS. 2 and 3, thereby appropriately covering and uncovering the indented second section 14.

Figure 2:
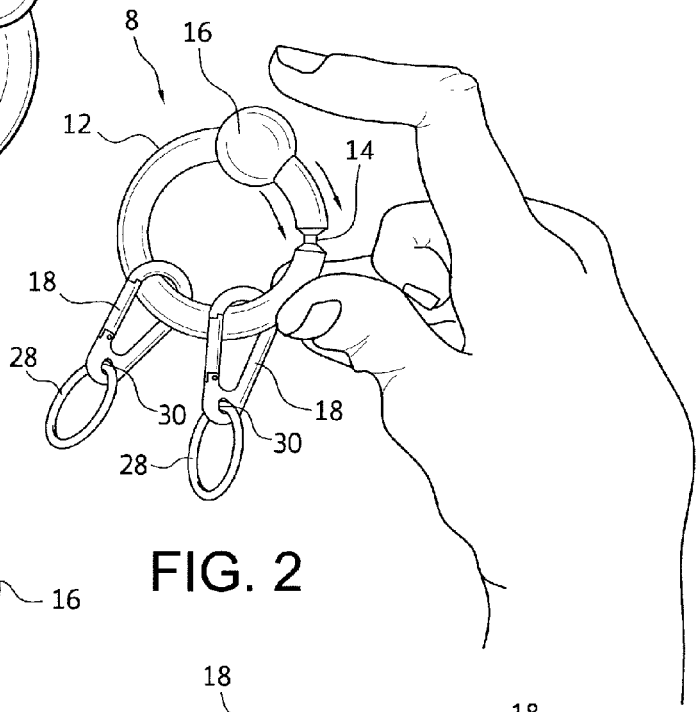
FIG. 2 is a view of the key ring showing the first securing device being moved toward the second indented section while spring clips with split key rings are attached to the key ring.
Figure 3:
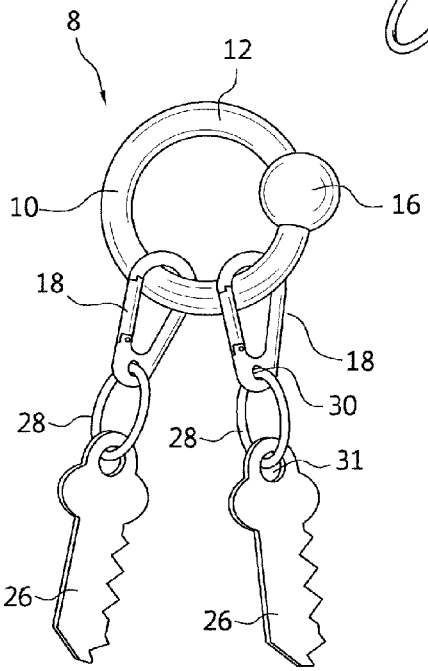
FIG. 3 is a view of the key ring showing the first securing device in a position concealing the second indented section while spring clips with split key rings with keys are attached to the key ring.

Although FIGS. 1-3 show securing device 16 having a spherical shape, it is appreciated the shape of the securing device 16 is immaterial, as long as it capable of covering the indented second section 14 and being retained in this position.

Figure 4:
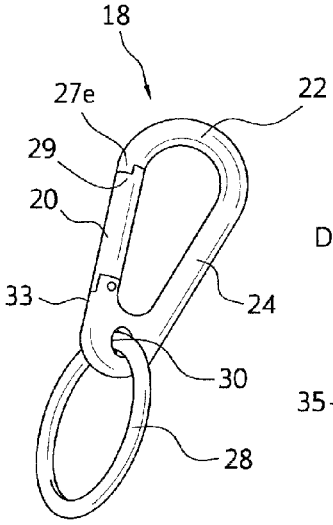
FIG. 4 is a view of a spring clip in a closed position.
Figure 5:
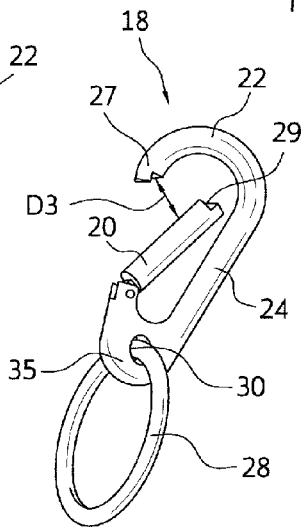
FIG. 5 is a view of the spring clip in an opened position.

As best shown in FIGS. 4 and 5, a spring clip 18 with a conventional split key ring 28 attached thereto is illustrated. The spring clip 18 is structured much like a conventional carbineer. The spring clip 18 includes a small hole 30 at its base end 35 which allows the split key ring 28 to be attached to the spring clip 18 by separating one of the ends of the split key ring 28 and threading the end through the small hole 30 in the same manner that keys are commonly attached to split key rings 28 such as those disclosed in accordance with the present invention. The split in the key ring 28 is concealed within small hole 30.

The spring clip 18 further includes a moveable arm 20 and an immobile fixed member 24 extending from the base end 35 of the spring clip 18 to a head section 22 and terminating at a hook 27 proximate to tip end 29 of the moveable arm 20. The moveable arm 20 is moveable between the closed position shown in FIG. 4 wherein the tip end 29 is proximate the hook 27 and the opened position illustrated in FIG. 5 wherein the tip end 29 is in contact with the immobile fixed member 24. The moveable arm 20 is resiliently and pivotally attached to a free end 33 of the fixed member 24 at the base end 35 so as to be biased in the closed position. Applying pressure to the moveable arm 20 allows the moveable arm 20 to shift from the closed position shown in FIG. 4 to the opened position illustrated in FIG. 5 wherein the tip end 29 of the moveable arm 20 abuts a portion of the immobile fixed member 24 between the base end 35 and the head section 22. The moveable arm 20 returns to the closed position shown in FIG. 4 when the pressure on the moveable arm 20 is discontinued.

It is important to note that the distance D3 between the tip end 29 of the moveable arm 20 and the end 27*e* of the hook 27 is greater than the thickness D2 on the indented second section 14, but less than the thickness D1 of the first section 12. The relationship between thickness D1, thickness D2 and distance D3 is highly important as it permits the spring clip 18 to be attached and removed from the continuous loop 10 of the key ring 8 only at the indented second section 14 having a thickness D2. Since distance D3 is smaller than thickness D1 it cannot be attached or removed from the continuous loop 10 of the key ring 8 anywhere along first section 12, which has a thickness of D1.

Therefore, the spring clip 18 can only be placed on, or removed from, the key ring 8 at the indented second section 14. Still further, this may only be done when the indented second section 14 is uncovered by moving the securing device 16 to the position shown in FIG. 1. Once indented second section 14 is uncovered and available for the application of the spring clip 18, pressure is applied to the moveable arm 20 of the spring clip 18 to pivot the moveable arm 20 to the opened position shown in FIG. 5. The spring clip 18, with pressure still applied to the moveable arm 20, is placed over the indented second section 14, thereby securing the spring clip 18 with the split key ring 28 and keys 26 attached thereto to the key ring 8. The pressure is then released from the moveable arm 20 of the spring clip 18, allowing the moveable arm 20 to move to the closed position shown in FIG. 4. The keys 26 include an opening 31 which allows them to be attached to the split key ring 28 attached to spring clip 18.

The spring clip 18 is then moved along the circumference of the continuous loop 10 of the key ring 8 to a position on the first section 12. The securing device 16 is then moved, as shown in FIG. 2, to the position illustrated in FIG. 3 with the indented second section 14 completely covered by the securing device 16. With the securing device 16 covering the indented second section 14 the spring clip 18 and the keys 26 are securely attached thereto to the key ring 8 since the spring clip 18 may only be removed when positioned at the indented second section 14. That is, with the securing device 16 in place covering the indented second section 14, when pressure is applied to the moveable arm 20 of the spring clip 18, moving the moveable arm 20 to the opened position shown in FIG. 5, the spring clip 18 could not be removed from the key ring 8. Once again, this is due to the fact that the distance D3 between the tip end 29 and the end of the hook 27 when the spring clip 18 is in the opened position is less than the thickness D1 of the first section 12 of the continuous loop 10. It is only when the securing device 16 is moved to the position shown in FIGS. 1 and 2 that the spring clip 18 can be removed from the key ring 8.

It will be appreciated that each of the keys 26 includes an aperture therein which permits them to be secured to the split key ring 28 in the conventional manner described in the Background of the Invention.

Figure 6:
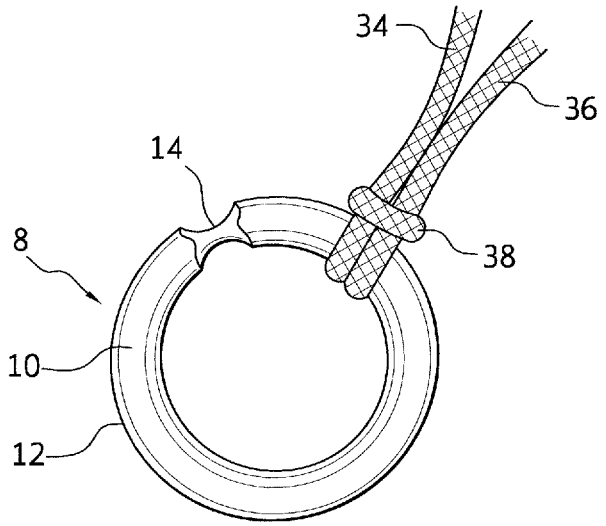
FIG. 6 is a view of the key ring showing a second securing device for concealing the second indented section and thus securing the spring clips with split key rings to the key ring.

FIGS. 6-9 depict alternative securing devices for securing the spring clip 18 with split key ring 28 and keys 26 attached thereto to the key ring 8. As shown in FIG. 6, a single piece of rope or cord 32 is tied in one loop, resulting in two strands 34, 36 and a knot 38, attached to the key ring 8. The knot 38 allows the rope or cord 32 to move over the entire circumference of the continuous loop 10, including both the first section 12 and the indented second section 14. Similar to the movement of the spherical securing device 16, the rope or cord 32 moves across the surface of the key ring 8 when sufficient pressure is applied to the rope or cord 32 to overcome the frictional attraction between the surface of the continuous loop 10 and the rope or cord 32, thereby covering and uncovering the indented second section 14. As was true with respect to FIGS. 1-5, the spring clip 18 can only be removed from or added to the key ring 8 when the indented second section 14 is uncovered by the rope or cord 32.

Figure 7:
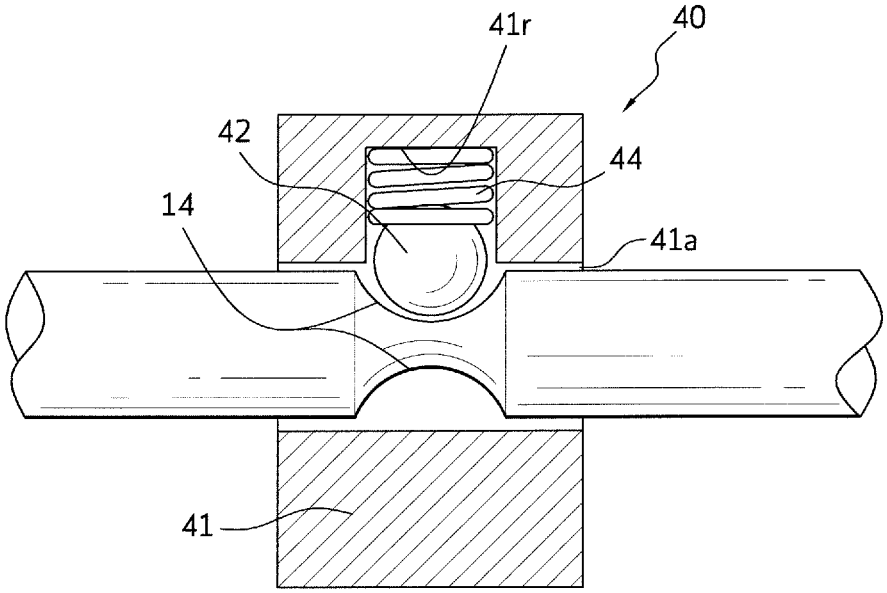
FIG. 7 is a view of a third securing device for concealing the second indented section and thus securing the spring clips with split key rings to the key ring.

FIG. 7 illustrates another securing device 40 used in controlling the attachment and detachment of the spring clip 18 to the key ring 8. The securing device 40 includes an enclosure 41 with an aperture 41*a* permitting movement of the securing device 40 across the entire circumference of the continuous loop 10, including both the first section 12 and the indented second section 14. The enclosure 41 includes a recess 41*r* in communication with the aperture 41*a*. A small spherical ball 42 is positioned within the recess 41*r* and is biased inwardly toward the aperture 41*a* by a spring 44. Therefore, when the enclosure 41 is positioned over the indented second section 14, the small spherical ball 42 is forced inwardly by the spring 44 to sit on the indented second section 14 in a manner interfering with further movement of the securing device 40 relative to the continuous loop 10 and thereby maintaining the enclosure 41 in place covering the indented second section 14. When sufficient lateral pressure is applied to the exterior of the enclosure 41, the small spherical ball 42 exerts sufficient pressure on the spring 44 forcing the small spherical ball 42 to move from the indented second section 14 and into the recess 41*r*, thereby allowing the enclosure 41 to move from a first position covering the indented second section 14 to a second position covering a portion of the first section 12 of the continuous loop 10, and uncovering the indented second section 14.

Figure 9:
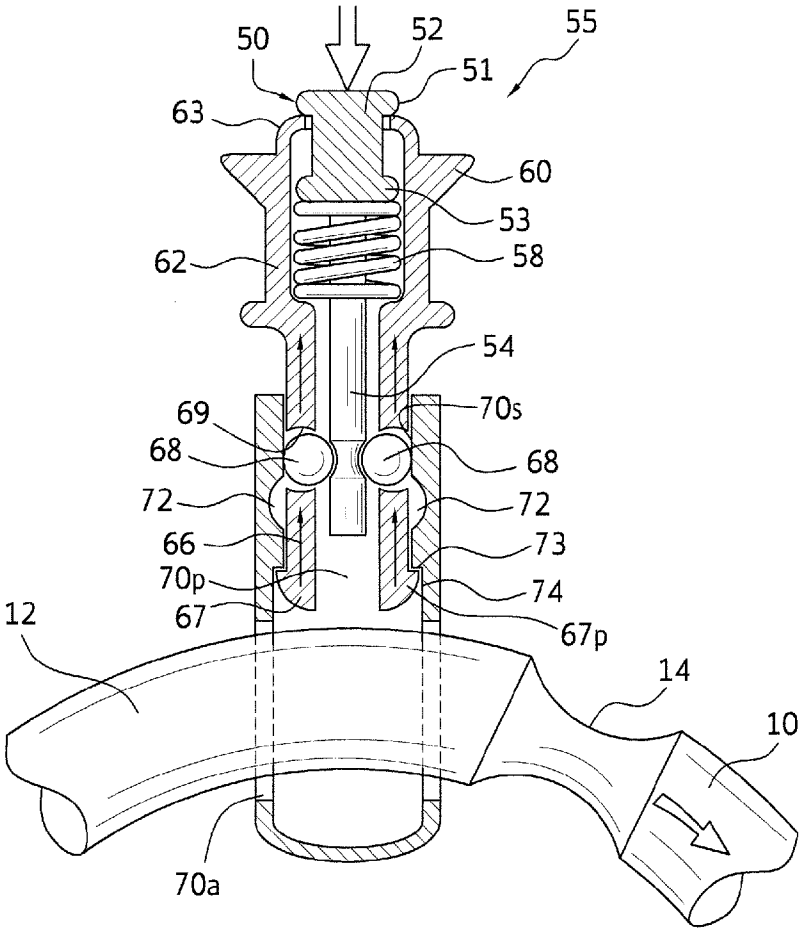
FIG. 9 is a view of the key ring with the fourth securing device not concealing the second indented section.
Figure 8:
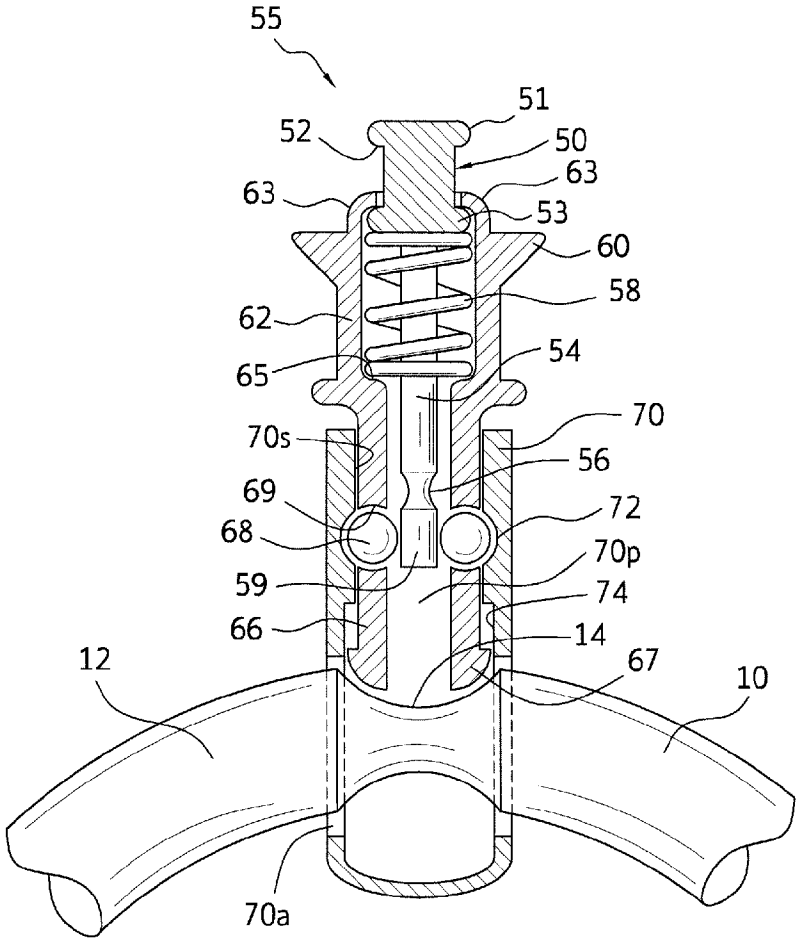
FIG. 8 is a view of the key ring including a fourth securing device concealing the second indented section.

FIGS. 8 and 9 show yet another device to secure the spring clip 18, and hence the keys 26, to the key ring 8. This securing device 55 comprises a quick release ball type locking pin having an elongated housing 70 and a moveable housing 60 which interact for selective movement thereof along the continuous loop 10 so as to cover and uncover the indented second section 14 of the continuous loop 10. As will be appreciated based upon the following disclosure, the moveable housing 60 is positioned within, and moves relative to, the elongated housing 70 to permit controlled movement of the securing device 55 along the continuous loop 10. With this in mind, the elongated housing 70 includes a loop aperture 70*a* which is perpendicular to the length of the housing and shaped and dimensioned for receiving the continuous loop 10 in a manner permitting movement of the continuous loop 10 relative to the elongated housing 70. The elongated housing 70 also includes a pin aperture 70*p*, which extends in a direction substantially transverse to the loop aperture 70*a*. The pin aperture 70*p* is shaped and dimensioned to receive the moveable housing 60 and the release pin 50 as discussed below.

The securing device 55 includes a quick release pin 50 extending within the moveable housing 60 and the elongated housing 70. The quick release pin 50 includes a head 52 from which a cylindrical pin shaft 54 extends. Head 52 includes an upper projection 51 and a lower projection 53. The cylindrical pin shaft 54 includes an indented ball receiving section 56 and an enlarged ball engaging end 59. The release pin 50 is biased upwardly or outwardly by a spring 58 positioned in the moveable housing 60 between the lower projection 53 of head 52 and shoulder 65 of the moveable housing 60.

The moveable housing 60 includes an upper section 62 having an inward lip 63 and a lower shoulder 65. Position between the inward lip 63 and a lower shoulder 65 is the spring 58 which is retained in its position between the head 52 of the release pin 50 and the body of the moveable housing 60. The moveable housing 60 also includes a lower section 66 which moves in and out of the indented second section 14. Between the upper section 62 and lower section 66 are two or more balls 68 retained in apertures 69 formed in the moveable housing 60. The lower section 66 of the moveable housing 60 is retained within the elongated housing 70 and elongated housing 70 is secured about the key ring 8. The internal surface 70*s* of the elongated housing 70, within the pin aperture 70*p*, includes an internal ball recess 72. The elongated housing 70, at the juncture of the pin aperture 70*p* and the loop aperture 70*a*, also includes an internal recess 74 into which a distal end 67 of the moveable housing 60 can move in and out. The recess 74 includes a shoulder 73 and the distal end 67 includes a projection 67*p*. The shoulder 73 and projection 67*p* contact one another to prevent movable housing 60 from being separated from elongated housing 70.

As shown in FIG. 8, the securing device 55 is in its locked position with the balls 68 forced into ball recess 72 by the enlarged ball engaging end 59 of the release pin 50. In this position, the distal end 67 of the moveable housing 60 is retained in the indented second section 14 and cannot be moved out of the indented second section 14 until the head 52 is pressed causing the indented ball receiving section 56 of the pin shaft 54 to align with the balls 68. When the release pin 50 is pressed as shown in FIG. 9 the balls 68 are allowed to move into the indented ball receiving section 56 and out of the internal ball recess 72, thus allowing the movable housing distal end 67 to move into recess 74 thereby allowing the securing device 55 to be moved from the indented second section 14 to first section 12.

While the preferred embodiments have been shown and described, it will be understood that there is no intent to limit the invention by such disclosure, but rather, is intended to cover all modifications and alternate constructions falling within the spirit and scope of the invention.

The invention claimed is:

1. A key ring and one or more spring clips securable to the key ring, the key ring comprising:

a continuous loop of material including a first section and an indented second section, the first section extending for the majority of the circumference of the continuous loop of material having a thickness of D1, and the indented second section extending for the remainder of the circumference of the continuous loop having a thickness D2 less than D1;

a securing device slidable about the continuous loop to selectively cover and uncover the indented second section, wherein the securing device is frictionally retained on the continuous loop of material;

each of the one or more spring clips includes:

a moveable arm having a tip end and a fixed member to which the moveable arm is attached, the moveable arm moving between an opened position and a closed position, wherein a distance D3 is provided between the tip end of the moveable arm and the fixed member when the moveable arm is in the opened position abutting the fixed member, the distance D3 is greater than D2, and less than D1; and wherein the one or more spring clips can only be attached to and removed from the continuous loop of material at the indented second section when the indented second section is not covered by the securing device.

2. The key ring according to claim 1, wherein the securing device is spherical in shape.

3. The key ring according to claim 1, wherein the moveable arm of the spring clip is biased in the closed position and pivots about the fixed member.

4. The key ring according to claim 1, wherein the securing device is a section of rope or cord with a knot.

5. The key ring according to claim 1, wherein the securing device is an enclosure provided with a spring biased ball.

6. The key ring according to claim 1, wherein the securing device is a quick release ball type locking pin.

7. The key ring according to claim 6, wherein the quick release ball type locking pin includes a movable housing secured within an elongated housing, the elongated housing having a length with an aperture perpendicular to the length in which the continuous loop of material resides.

8. The key ring according to claim 7, wherein the elongated housing includes a recess with a shoulder and the movable housing includes a projection which contacts the shoulder to prevent separation of the movable housing from the elongated housing.

9. The key ring according to claim 8, wherein the movable housing retains a spring biased quick release pin therein.

10. The key ring according to claim 8, wherein the spring biased quick release pin includes an indented ball receiving section which cooperates with balls retained in apertures in the movable housing, wherein the balls further cooperate with an internal ball recess forming in the elongated housing.

11. The key ring according to claim 1, wherein the spring clips include a split key ring attached thereto.

12. The key ring according to claim 1, wherein the securing device is an enclosure provided with a spring.

* * * * *